US006394451B1

(12) United States Patent
Yi

(10) Patent No.: US 6,394,451 B1
(45) Date of Patent: May 28, 2002

(54) STRUCTURE OF A PLAYING FIGURE FOR SOCCER GAME TABLES

(76) Inventor: Tien Feng Yi, P.O. Box 82-144, Taipei (TW)

( * ) Notice: Subject to any disclaimer, the term of this patent is extended or adjusted under 35 U.S.C. 154(b) by 0 days.

(21) Appl. No.: 09/496,177

(22) Filed: Feb. 2, 2000

(51) Int. Cl.[7] ..... A63F 7/06

(52) U.S. Cl. ..... 273/108.52; 273/108.54; 273/129 R

(58) Field of Search ..... 273/108, 108.1, 273/119 R, 129 R, 459, 461, 108.51, 108.53, 85 C, 85 D, 85 E, 85 F, 108.52, 108.54, 108.55, 108.56; D21/318; 15/105

(56) References Cited

U.S. PATENT DOCUMENTS 4,076,244 A * 2/1978 Peppard
5,377,981 A * 1/1995 Monneret
5,605,328 A * 2/1997 Rudell et al.

FOREIGN PATENT DOCUMENTS

IT 504648 * 12/1954 ..... 273/85 D
IT 518832 * 3/1955 ..... 273/85 D

* cited by examiner

*Primary Examiner*—Sebastiano Passaniti
(74) *Attorney, Agent, or Firm*—A & J

(57) ABSTRACT

A playing figure for soccer game tables comprising a rectangular, box-like playing area supported on four angularly mounted and reinforced legs, a plurality of axially slidable actuating rods mounted extending transversely of the playing area, and a plurality of playing figures mounted on the actuating rods, the improvement wherein the playing figures are each provided with a brush at a lower end thereof.

1 Claim, 2 Drawing Sheets

STRUCTURE OF A PLAYING FIGURE FOR SOCCER GAME TABLES

BACKGROUND OF THE INVENTION

1. Field of the Invention

This invention is related to an improvement in the structure of a playing figure for soccer game tables and in particular to one which can enlarge kicking range of the playing figure.

2. Description of the Prior Art

The conventional soccer game table generally includes a rectangular playing area, eight axially sidable actuating rods mounted extending transversely of the playing area, and twenty-four playing figures mounted on the actuating rods. Referring to FIG. 4, in order to avoid interference between two playing figures 102 when they are rotated to kick the ball 15, the playing area must be eight times as long as the rotating diameter of the playing figure 120 (or sixteen times as long as the rotating radius of the playing figure 120. In other words, the rotating radius of the playing figure 120 must be less than one-sixteenth of the length of the playing area. However, as shown in FIG. 4, if the ball 15 is located at the dead section 102 which has a range larger than the diameter of the ball 15, neither of the two playing figure 120 can kick the ball 15 thereby causing controversies in playing.

Therefore, it is an object of the present invention to provide an improvement in the structure of a playing figure for soccer game tables which can obviate and mitigate the above-mentioned drawbacks.

SUMMARY OF THE INVENTION

This invention is related to an improvement in the structure of a playing figure for soccer game table.

According to a preferred embodiment of the present invention, a playing figure for soccer game tables comprising a rectangular, box-like playing area supported on four angularly mounted and reinforced legs, a plurality of axially slidable actuating rods mounted extending transversely of the playing area, and a plurality of playing figures mounted on the actuating rods, the improvement wherein the playing figures are each provided with a brush at a lower end thereof.

It is the primary object of the present invention to provide an improved playing figure for soccer game tables which can enlarge the kicking range of the playing figure.

It is another object of the present invention to provide an improved playing figure for soccer game tables which enables the playing figure to kick the ball as any position.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 2:
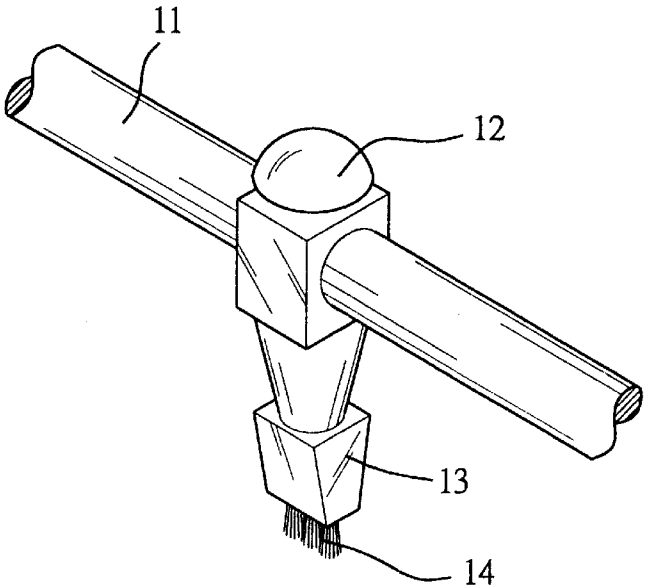
FIG. 2 is a perspective view of the playing figure.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 1:
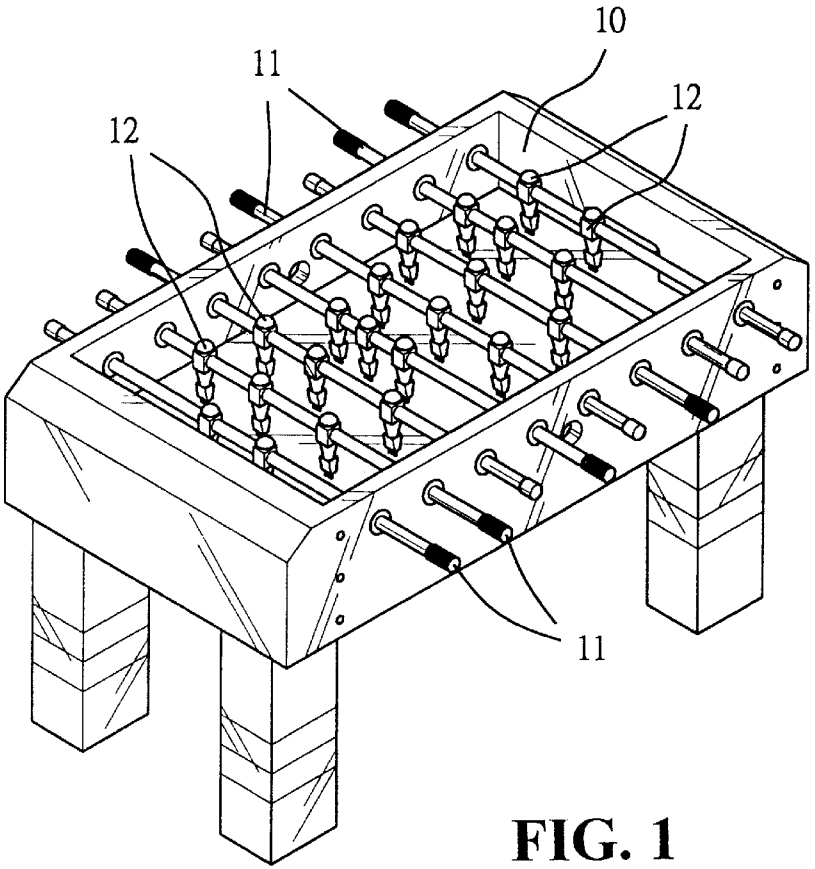
FIG. 1 is a perspective view of the present invention.
Figure 4:
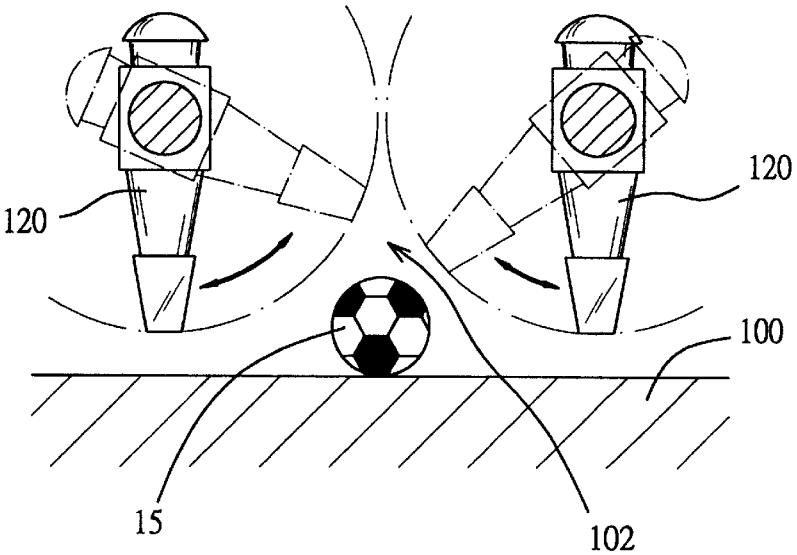
PRIOR ART FIG. 4
FIG. 4 illustrates the drawback of the prior art playing figure for soccer game tables.

With reference to the drawings and in particular to FIGS. 1 and 2 thereof, the soccer game table according to the present invention generally includes a rectangular, box-like playing area supported on four angularly mounted and reinforced legs, a plurality of axially slidable actuating rods 11 mounted extending transversely of the playing area, and a plurality of playing figure 12 mounted on the actuating rods 11. The playing figure 12 is provided with a brush 14 at the lower end 14 thereof.

Figure 3:
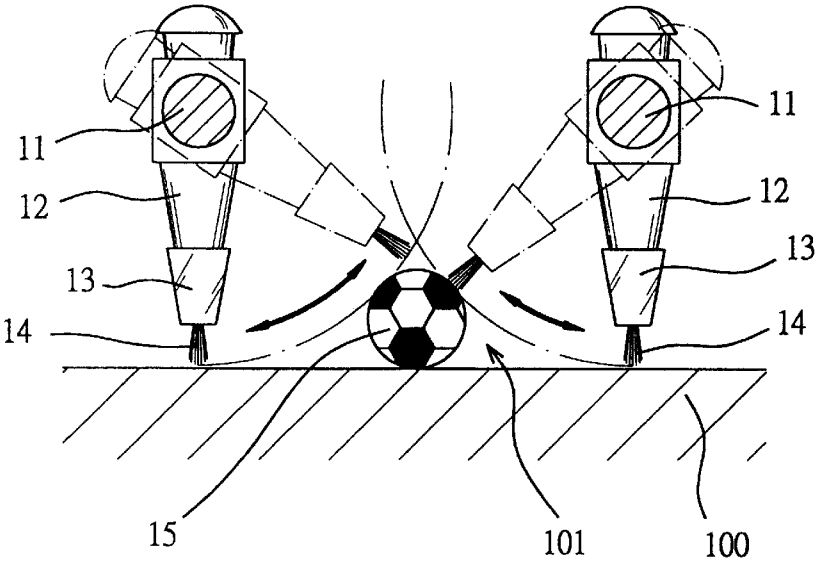
FIG. 3 illustrates the working principle of the present invention.

Referring to FIG. 3, even when two playing figure 12 are rotated by the actuating rods 11 simultaneously, only the brushes 14 of the playing FIG. 12 will collide with each other thereby preventing the playing figure 12 from damage. In addition, the contact between the brush 14 and the floor 100 will not cause any damage to the floor 100. Furthermore, the brush 14 can increase the rotating radius of the playing figure 12 thereby making the dead corner 101 become less than the diameter of the ball 15. As a consequence, the ball 15 can be kicked by the playing figure 12 without interference with the other.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A playing figure for soccer game tables including a rectangular box playing area supported on four angularly mounted and reinforced legs, a plurality of axially slidable actuating rods mounted within and extending transversely of the playing area, a plurality of playing figures mounted on the actuating rods with each of said playing figures having a lower end, and a game ball, the improvement comprising:

wherein said playing figures are each provided with a brush at the lower end thereof; said brush being dimensioned to a length that increases the rotating radius of the playing figure beyond the length of the body portion of the playing figure so that the dead area of the game table adjacent two of said playing figures is reduced to a dimension that is less than the diameter of the game ball, the brush of each one of said playing figures being structured to prevent collisions between two playing figure body portions while enabling one of said brushes to collide with the brush of an adjacently located playing figure, whereby the ball may be kicked by the brush of one of said playing figures without interference from the body portion of another adjacently located playing figure.

* * * * *